US010626680B2

(12) United States Patent
Rindeskar et al.

(10) Patent No.: US 10,626,680 B2
(45) Date of Patent: Apr. 21, 2020

(54) PERCUSSIVE ROCK DRILL BIT WITH FLUSHING GROOVES

(71) Applicant: SANDVIK INTELLECTUAL PROPERTY AB, Sandviken (SE)

(72) Inventors: Andreas Rindeskar, Hofors (SE); John Hammargren, Ockelbo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 59 days.

(21) Appl. No.: 15/114,605

(22) PCT Filed: Dec. 15, 2014

(86) PCT No.: PCT/EP2014/077784
§ 371 (c)(1),
(2) Date: Jul. 27, 2016

(87) PCT Pub. No.: WO2015/113694
PCT Pub. Date: Aug. 6, 2015

(65) Prior Publication Data

US 2016/0348442 A1 Dec. 1, 2016

(30) Foreign Application Priority Data

Jan. 31, 2014 (EP) ..... 14153364

(51) Int. Cl.
*E21B 10/38* (2006.01)
*E21B 10/40* (2006.01)

(52) U.S. Cl.
CPC ..... *E21B 10/38* (2013.01); *E21B 10/40* (2013.01)

(58) Field of Classification Search
CPC ..... E21B 10/38; E21B 10/40
USPC ..... 175/393
See application file for complete search history.

(56) References Cited

U.S. PATENT DOCUMENTS

| | | | |
|---|---|---|---|
| 3,357,507 A | 12/1967 | Stewart | |
| 3,388,756 A | 6/1968 | Varel et al. | |
| 5,794,728 A | 8/1998 | Palmberg | |
| 2002/0153174 A1 | 10/2002 | Linden et al. | |
| 2008/0087473 A1 | 4/2008 | Hall et al. | |
| 2010/0108398 A1 | 5/2010 | Niu | |
| 2014/0299388 A1* | 10/2014 | Rindeskar | E21B 10/5673 175/430 |

FOREIGN PATENT DOCUMENTS

| | | |
|---|---|---|
| CN | 1846039 A | 10/2006 |
| CN | 101023240 A | 8/2007 |
| CN | 101061290 A | 10/2007 |
| DE | 3519592 A1 | 12/1986 |
| EP | 2592216 A1 | 5/2013 |
| GB | 692373 A | 6/1953 |

(Continued)

*Primary Examiner* — Taras P Bemko
(74) *Attorney, Agent, or Firm* — Corinne R. Gorski

(57) ABSTRACT

A percussive rock drill bit has a head and a shank in which a plurality of flushing grooves extend radially outward and axially rearward from a front face. The flushing grooves are configured to optimize the axially rearward flow of rock particles and fines entrained in the flushing fluid. In particular, each groove is generally convex relative to a longitudinal axis of the drill bit and is declined continuously relative to the axis from a first groove end to a second groove end.

12 Claims, 6 Drawing Sheets

(56) References Cited

FOREIGN PATENT DOCUMENTS

| | | | |
|---|---|---|---|
| RU | 2019674 | C1 | 9/1994 |
| RU | 19082 | U1 | 8/2001 |
| SU | 1560061 | A3 | 4/1990 |
| WO | 2006033606 | A1 | 3/2006 |
| WO | 2009067073 | A1 | 5/2009 |
| WO | 2013068262 | A1 | 5/2013 |

* cited by examiner

PERCUSSIVE ROCK DRILL BIT WITH FLUSHING GROOVES

RELATED APPLICATION DATA

This application is a § 371 National Stage Application of PCT International Application No. PCT/EP2014/077784 filed Dec. 15, 2014 claiming priority of EP Application No. 14153364.6, filed Jan. 31, 2014.

FIELD OF INVENTION

The present invention relates to a percussive rock drill bit and in particular, although not exclusively, to a drill bit having a head with a plurality of flushing grooves that are optimised via their orientation relative to an axis of the bit that greatly facilitate axially rearward flushing of fragments and fines cut from the rock face.

BACKGROUND ART

Percussion drill bits are widely used both for drilling relatively shallow bores in hard rock and for creating deep boreholes. For the latter application, a drill string is typically used in which a plurality of rods are coupled end-to-end via threaded joints as the depth of the hole increases. A terrestrial machine is operative to transfer a combined impact and rotary drive motion to an upper end of the drill string whilst a drill bit positioned at the lower end is operative to crush the rock and form the boreholes. WO 2006/033606 discloses a typically drill bit comprising a drill head that mounts a plurality of hard cutting inserts, commonly referred to as buttons. Such buttons comprise a carbide based material to enhance the lifetime of the drill bit.

Fluid is typically flushed through the drill string and exits at the base of the borehole via apertures in the drill head to flush the rock cuttings from the boring region to be conveyed backward and through the bore around the outside of the drill string. Further examples of percussive drill bits are disclosed in DE 3519592; U.S. Pat. No. 3,388,756; GB 692,373; RU 2019674; US 2002/0153174; U.S. Pat. No. 3,357,507, US 2008/0087473; WO 2009/067073 and WO 2013/068262.

Typically, a plurality of flushing grooves are recessed in the drill head to allow the fractured material to be transported rearwardly from the drill bit via the flushing fluid. U.S. Pat. No. 5,794,728 discloses a percussion rock drill bit having a plurality of fluid passageways that extend from a central bore of the bit to emerge at flushing grooves at the front face. However conventional bits are disadvantageous for a number of reasons. In particular, conventional flushing grooves are not optimised to facilitate fluid flow axially rearward from the front face and this reduces accordingly the drilling performance and in particular the penetration rate of the bit. Additionally, it is not uncommon for the axially forwardmost part of the flushing fluid passageway to become damaged due to contact with the rock that in turn decreases the delivery of fluid to the front face and also the efficiency of rearward flushing of fines and debris material cut from the rock face. Accordingly, what is required is a drill bit that addresses the above problems.

SUMMARY OF THE INVENTION

It is an objective of the present invention to provide a percussive rock drill bit that is optimised for drilling efficiency and in particular to provide an enhanced drilling penetration rate. It is a further specific objective to provide a drill bit that is effective to optimise the axially rearward flushing of rock debris and fines cut from the rock face. It is also a specific objective of the present invention to reduce as far as possible damage to the fluid flushing passageways due to contact with the rock face during cutting.

The objectives are achieved by providing a drill bit having flushing grooves that extend radially outward from a central axis of the bit and axially rearward from the bit head to the bit shank having optimised fluid flow path lengths. The optimisation is achieved as the fluid flow path length within the grooves (from the axially forwardmost region of the head to the radially outer perimeter of the head at the region of the shank) is devoid of ridges or sharp angled transitions that would otherwise perturb the fluid flow and accordingly reduce the efficiency with which the cut fragments and fines (that are entrained in the flushing fluid) flow axially rearward through the grooves. Additionally, the present bit is optimised to protect the axially forwardmost region of the fluid flow passageways from damage by the rock face via the position of emergence of the passageways within the flushing grooves. That is, the annular leading edge that defines the exit aperture (in the vicinity of the front face) of the flushing passageway is positioned at the trough region of each respective flushing groove such that this aperture edge is positioned axially rearward from the front face and is accordingly set back from the rock face during cutting to avoid frictional contact damage with the rock. The shape profile of the passageway exit aperture is accordingly preserved following extended use. Accordingly, the intended fluid flow pathways of the fluid delivered by the passageways remain unaffected by use of the drill head and in particular damage or wear at the front face.

Advantageously, the flushing grooves have a fluid flow path that is generally convex relative to an axis of the bit and that is continuously angled rearwardly away from the front face (relative to the axis) to facilitate the axially rearward flow. As such, the present flushing grooves are devoid of any regions in the fluid flow length that could be regarded as perpendicular to the axis that would otherwise deflect the fluid flow radially outward. Such arrangements are common to existing bit configurations and have the effect of disrupting the axially rearward fluid flow by presenting obstructions to the particles and fines as they travel radially outward from the axis and axially rearward from the bit face.

According to a first aspect of the present invention there is provided a percussive rock drill bit comprising: a head provided at one end of an elongate shank having an internal bore extending axially from one end of the shank towards the head; the head having a front face and a plurality of collar segments spaced circumferentially around a longitudinal axis of the bit and positioned at a perimeter of the front face, the front face being generally dome-shaped; a plurality of front cutting buttons provided at the front face and a plurality of gauge cutting buttons provided at the collar segments; a plurality of flushing grooves extending in a direction radially outward from the axis at the front face and continuing in a direction axially rearward to define and circumferentially separate the collar segments, each of the grooves terminating at the vicinity of the shank; at least one fluid passageway connected to the bore and emerging as an aperture in the vicinity of the front face within at least one of the flushing grooves, the aperture being recessed axially from the front face within the at least one groove; characterised in that: a flow path length of each of the flushing grooves is generally convex in the direction from the front face to the shank relative to the axis of the bit; and the flow path length is aligned to extend continuously axially rearward from the region of the aperture towards the shank such that no part of the flow path length is aligned perpendicular to the axis of the bit so as to provide an unhindered axially rearward flow path for fluid to flow from the aperture towards the shank and between the collar segments.

The subject invention is to be contrasted with existing drill bits that typically comprise a ridge, shoulder or relatively sharp angled transition that is aligned perpendicular to the elongate main length of each groove and positioned at the transition between the generally radially extending front face and the generally axially extending rearward region of the head. Accordingly, the subject invention is advantageous to allow the unhindered axially rearward flow of entering rock particles within the flushing fluid. In particular, and preferably each of the grooves comprise a first region positioned generally at the front face and a second region positioned generally between each of the collar segments wherein a transition between the first and second regions is seamless and is devoid of any ridge or edge aligned perpendicular to the fluid flow path of each of the grooves. The transition region between the axially forward region of the head and the axially rearward region of the head has been optimised according to the subject invention to have the effect of channelling or funnelling the fluid axially rearward and not directing the fluid flow radially outward. Accordingly, the flushing fluid is retained within each groove and this provides optimisation of the axially rearward transport of the cut rock fragments that in turn increases the penetration rate of the drill bit and hence a reduction in the overall drilling time for a given depth.

Preferably, each of the grooves extend axially forward beyond each aperture. Such an arrangement is advantageous to capture cut rock particles at the very forwardmost region of the drill head.

Preferably, an angle of alignment of the flow path length of each of the grooves in the first region axially forward and axially rearward of the aperture is substantially equal. The relative orientation of each groove at the region of the aperture provides for the unhindered flow of fluid and efficient transport of rock particles from the first (axially forward) to the second (axially rearward) ends of the grooves. The present grooves are configured to provide minimal disruption to the fluid flow and hence the undesirable ' gathering' or accumulation of rock particles at regions of the grooves that may otherwise hinder the axially rearward flow. Preferably, each of the grooves at the transition between the first and second regions comprises a convex curve in the flow path length relative to the axis.

The curvature at the transition region may be represented by an arc of a circle having a single radius corresponding approximately to a radius of the head and/or cylindrical shank.

Optionally, the flow path length in the first region is aligned to be declined to slope towards the axis at an angle in the range 40 to 80°, 45 to 65° or 50 to 60° relative to the axis. Optionally, the flow path length in the second region is aligned to be declined to slope towards the axis at an angle in the range 5 to 30°, 10 to 25° or 10 to 20° relative to the axis. The angle of inclination corresponds to the angle extending between the axis and a trough region of each groove through an axial cross section of the drill bit. When viewed as a cross section through each groove in an axial plane bisecting the groove trough region, each groove comprises a generally convex shape profile relative to the axis having a generally dome-shaped profile. Sidewalls that define each groove may be curved in a circumferential direction around the axis such that the width of the groove perpendicular to its flow path length may increase according to a generally V- or U-shaped profile. Such an arrangement is advantageous to maintain the fluid flow within the grooves and to optimise the axially rearward flow of particles within each groove.

Preferably, the front face is generally dome-shaped and is devoid of regions aligned substantially perpendicular to the axis. Such regions aligned perpendicular to the axis may otherwise significantly disrupt the axially rearward transport of rock particles.

Preferably, each collar segment comprises gauge buttons and the front face comprises front buttons. Optionally, the drill bit comprises three front buttons and six gauge buttons. Optionally, two gauge buttons are provided on each collar segment and are positioned circumferentially between each of the grooves. Having the same number of grooves and front buttons has been found to optimise the rate of rock fracture relative to the rate by which the fractured particles are transported axially rearward. Similarly, the subject invention comprises twice the number of gauge buttons relative to the number of grooves to optimise cutting without compromising axially rearward transport of fractured debris material.

Preferably, a depth of each of the grooves increases generally from the front face towards the shank. The groove depth is optimised so as to provide a greater volume towards the axially rearward end of each groove so as to accommodate an increasing volume of debris particles transferred to the groove from the region of the gauge buttons. Again, such an arrangement is advantageous to optimise cutting and flushing of the rock particles.

Preferably, the device further comprises a trench axially recessed in the font face and extending circumferentially around the axis and perpendicular to the grooves, with each aperture positioned on the circumferential path of the trench such that an axial depth of the trench and each groove at the vicinity of each aperture is substantially equal. The trench is effective to provide a recessed region for each aperture of the passageways. In particular, the radially inner part of the trench is defined by a shoulder that acts to deflect and shield the annular edge (that defines the aperture) from the rock face and debris material.

Optionally, the drill bit comprises three flushing passageways and three grooves. Accordingly, each groove is provided with its own respective fluid flow. As will be appreciated, the specific number and configuration of front buttons, gauge buttons and grooves may vary within the scope of the subject invention having consideration of cutting efficiency without compromising or being detrimental to the axially rearward transport of cut material.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
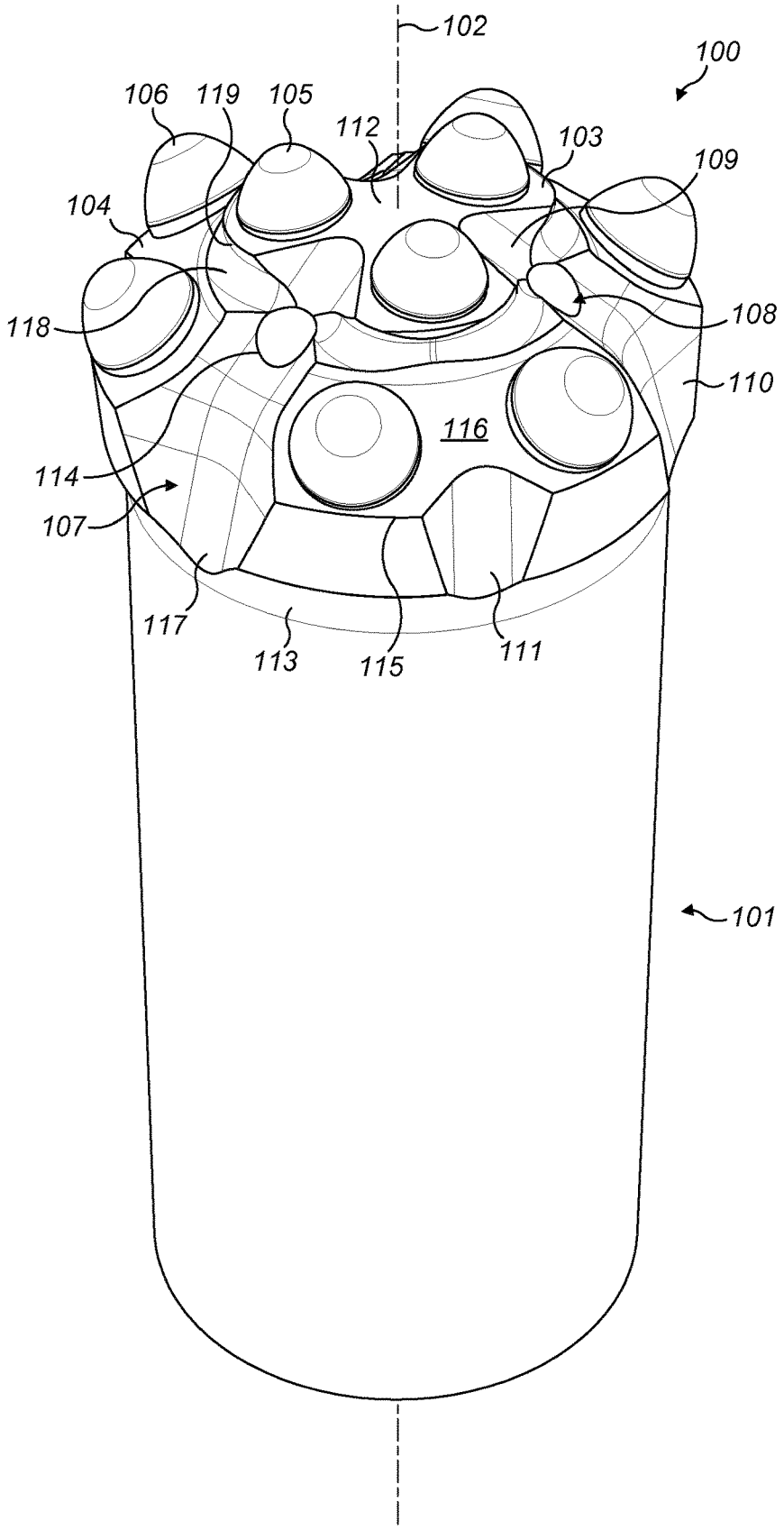
FIG. 1 is an external perspective view of a percussive rock drill bit having a head and a shank with a plurality of flushing grooves extending over the head according to a specific implementation of the present invention.
Figure 2:
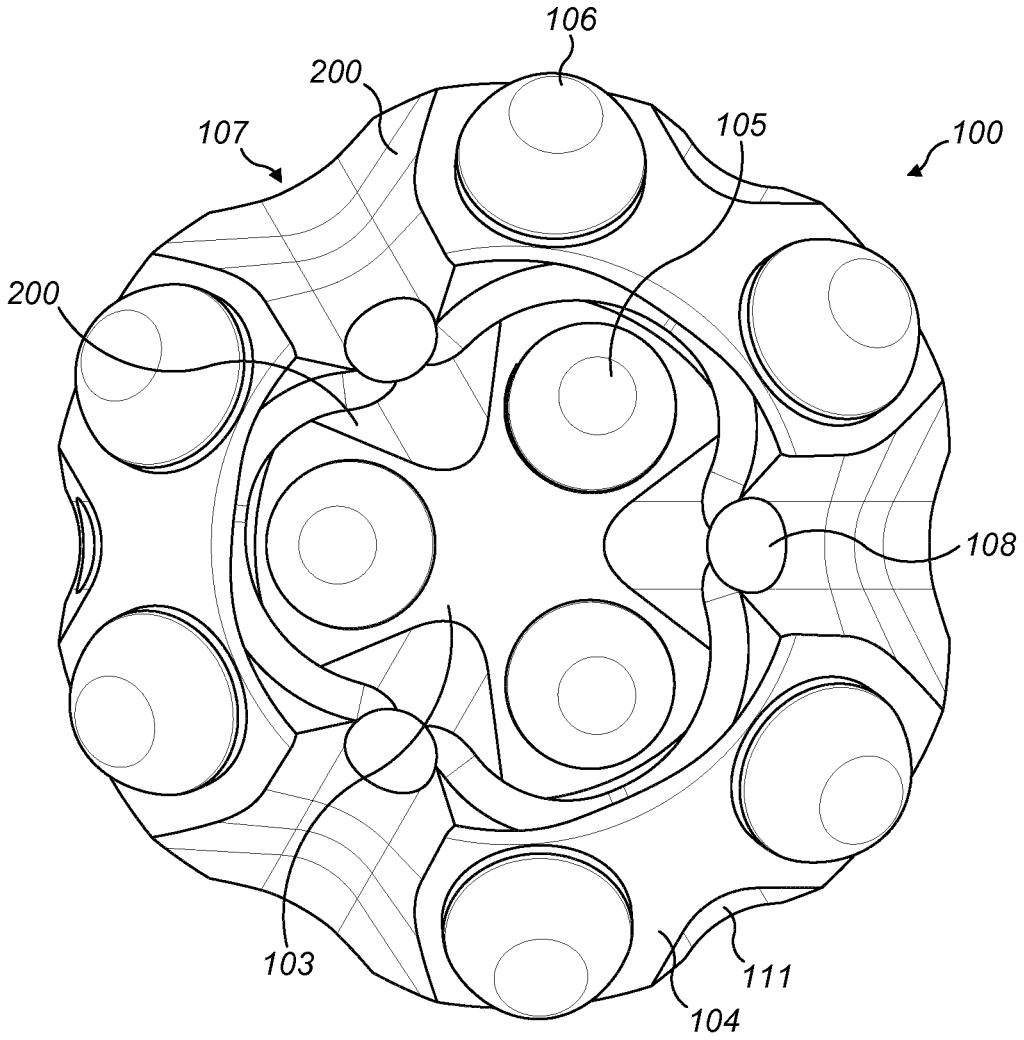
FIG. 2 is an external end view of the head of the drill bit of FIG. 1.
Figure 3:
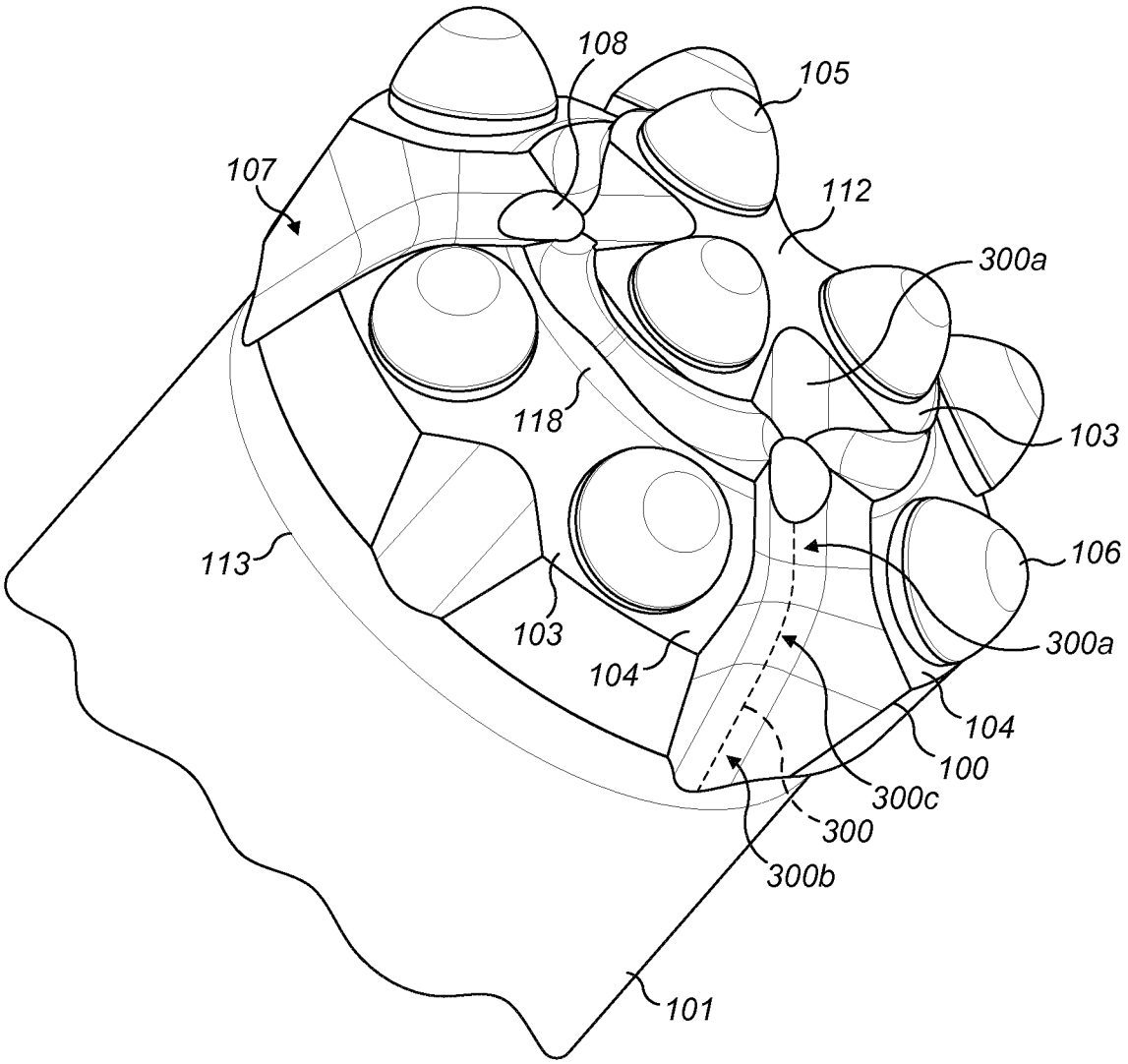
FIG. 3 is a further external perspective view of the bit head of FIG. 1.

Referring to FIGS. 1 to 3 a percussive rock drill bit comprises a bit head 100 and a shank 101 that projects rearwardly from head 100. Both head 100 and shank 101 are centred on an elongate bit axis 102. The head 100 comprises a plurality of hardened cutting inserts (referred to herein as cutting button). In particular, the buttons may be categorised into front buttons 105 and gauge buttons 106. Head 100 is generally dome shaped having an apex region 112 that represents an axially forwardmost region of a front face 103 that represents the forward facing surface of head 100. Front face 103 is angled to be declined in a rearward direction from axis 102 and is bordered at its perimeter by a plurality of collar segments 104. Collar segments 104 represent peripheral islands distributed circumferentially around axis 102 and formed generally at the junction between head 100 and shank 101.

Front buttons 105 are located at front face 103 in close proximity to apex 112 and axis 102. The radially outer gauge buttons 106 are provided on the collar segments 104. According to the specific implementation, head 100 comprises three front buttons 105 and six gauge buttons 106, with each collar segment 104 comprising two gauge buttons 106. Front face 103 encompasses the forward facing surface 116 of collar segments 104 and is generally continuously tapered axially rearward from apex 112 to a head perimeter edge 115 that represents the maximum outside diameter of head 100.

A plurality of flushing grooves indicated generally by reference 107 are arranged over head 100. A first groove region 109 extends generally radially outward from axis 102 and a second groove region 110 extends generally axially rearward from front face 103 and in particular apex 112. Each groove 107 is recessed into head 100 such that a trough region 117 of each groove 107 is recessed axially rearward of the front face 103. Each groove 107 is further defined by sloping side faces 200 that provide a generally smooth transition from collar segment surfaces 116 and groove trough region 117. Grooves 107 comprise a generally V-shaped profile and configuration as defined by wall surfaces 200 and trough 117. The V-shaped profile extends generally along the full length of each groove 107 in the vicinity of apex 112 and a transition region 113 between shank 101 and head 100.

The drill bit further comprises a plurality of apertures 108 located at front face 103 and in particular at the trough region 117 of each groove 107. Each aperture 108 is defined by a substantially circular edge 114 having a diameter being smaller than a diameter of cutting buttons 105, 106. According to the specific implementation, the drill bit comprises three apertures 108 each located within a respective groove 107 and positioned radially between front buttons 105 and gauge buttons 106. However, apertures 108 are positioned off-set or to one side of an imaginary radial spoke extending through each of the front buttons 105 and gauge buttons 106. That is, the region of head 100 radially inward and radially outward from aperture 108 is devoid of a cutting button 105, 106 respectively.

Head 100 further comprises a plurality of channels 111 that extend axially within the outer perimeter of collar segments 104 having an axial length corresponding approximately to the axial distance between head perimeter edge 115 and transition region 113. According to the specific implementation, head 100 comprises three channels 111 positioned respectively at each one of three collar segments 104. According to the specific implementation, a depth (in a radial direction) of channels 111 is appreciably less than a corresponding depth of grooves 107. Additionally, channels 111 do not extend radially inward beyond collar segment surface 116 and gauge buttons 106.

Referring to FIG. 3, each groove 107 comprises a main length represented generally by reference 300 that is orientated to extend in both a radial and axial direction from apex region 112 to transition region 113. The groove main length 300 represents a fluid flow path length over which a flushing fluid is configured to flow from each aperture 108 radially outward and axially rearward from front face 103 towards transition region 113 (and subsequently axially rearward along shank 101). In particular, flow path length 300 comprises a first region 300*a* that extends generally radially outward from apex 112 to a region between collar segments 104. The path length then curves back towards central axis 102 at intermediate curved region 300*c*. Groove 107 then continues in a generally axially rearward direction at path length second region 300*b* extending between curved region 300*c* and transition region 113. Accordingly, fluid flow path length 300 is continuously declined towards axis 102 over both first and second regions 300*a*, 300*b* and curved intermediate region 300*c*. Additionally, the path length 300 at regions 300*a*, 300*b*, 300*c* is devoid of any ridges, edges, sharp transitions, shoulders or other obstacles aligned perpendicular or transverse to the fluid flow path length 300 that would otherwise represent obstructions to a fluid flowing from aperture 108 to transition region 113. Such an arrangement is advantageous to optimise the rearward flushing of rock particles and fines detached from the rock face. The present arrangement also ensures that the fluid and rock particles are retained within the grooves 107 and do not 'spill' onto the front face region 103.

Figure 4:
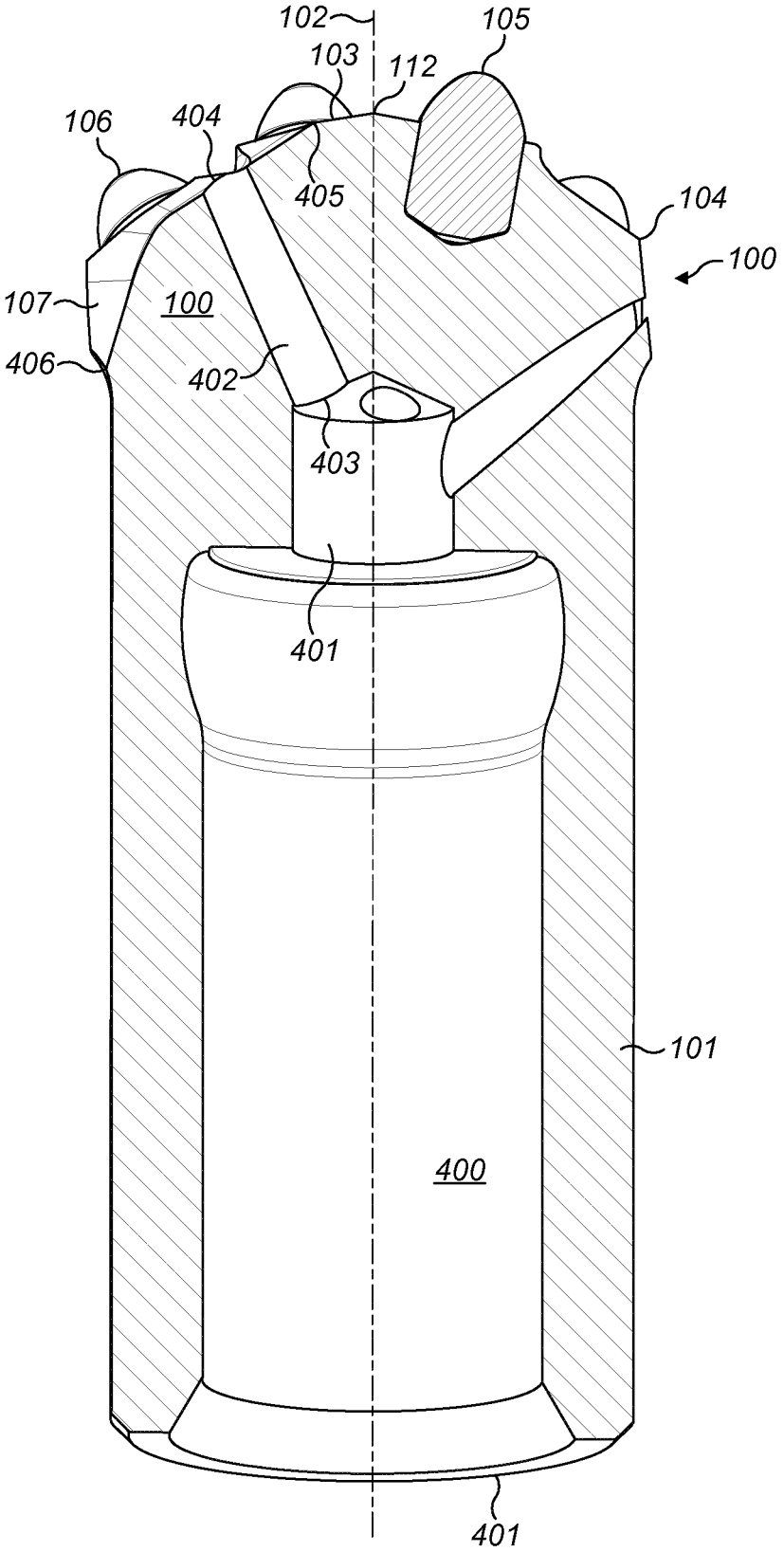
FIG. 4 is an axial cross sectional view through the percussive drill bit of FIG. 1.
Figure 6:
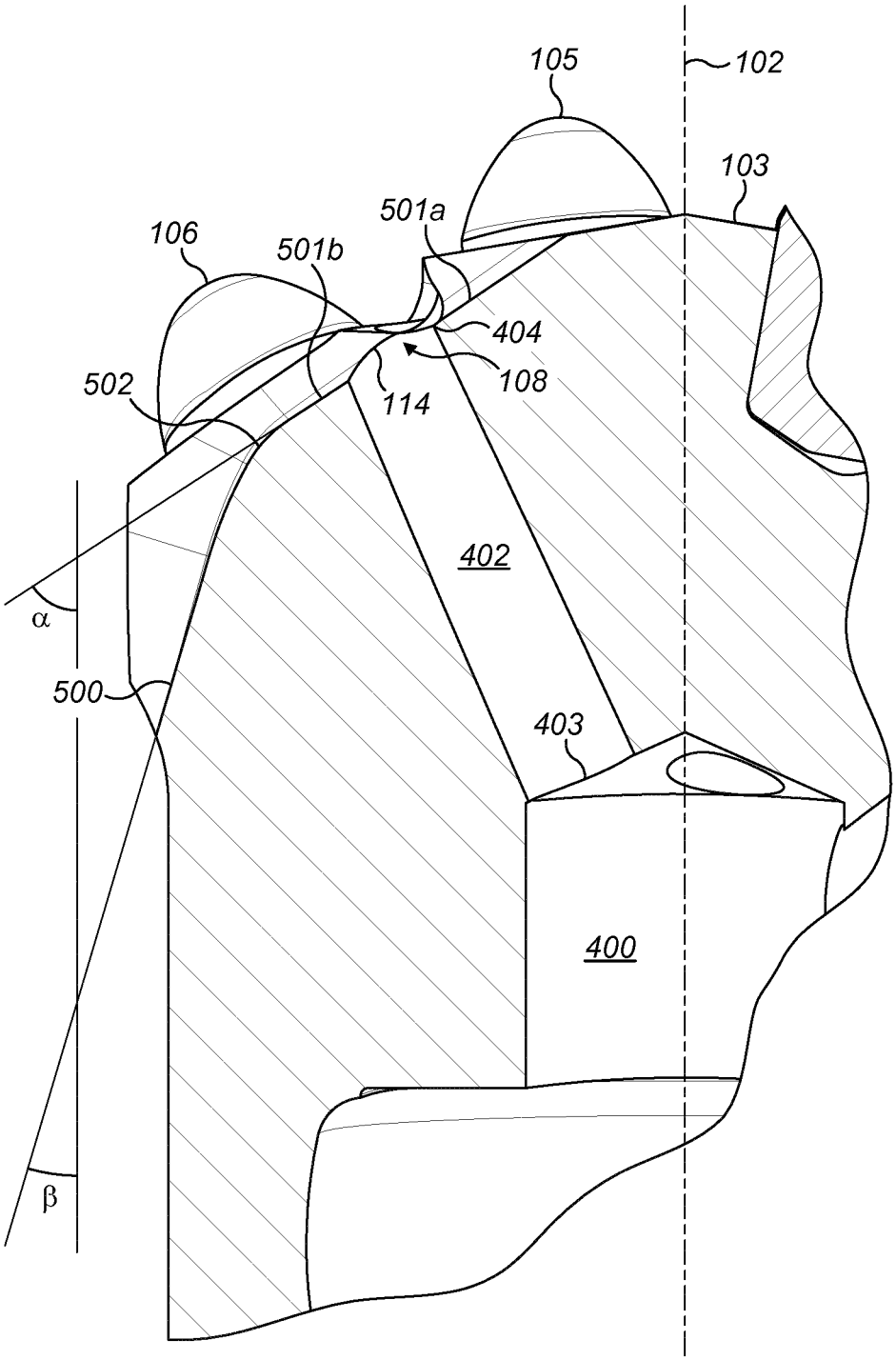
FIG. 6 is a further magnified perspective cross sectional view of the bit head of FIG. 4.

Referring to FIGS. 4 and 6, the cutting bit comprises a longitudinal extending inner central bore 400. Bore 400 extends from one end 401 of shank 101 and is terminated at head 100 by a plurality of fluid flow passageways 402. Passageways 402 each comprise a first end 403 connected in fluid communication with bore 400 and a second end 404 that terminates at front face 103 as aperture 108 (as defined by edge 114). Due to the relative positioning of apertures 108 at front face 103, each passageway 402 extends radially outward from axis 102. So as to protect aperture edge 114 from damage caused by contact with the rock face, each edge 114 is recessed axially rearward from front face 103 by positioning at the trough region 117 of each groove 107. Each aperture 108 is positioned axially closer to apex 112 relative to transition region 113. In particular, each groove 107 comprises a first end 405 positioned at the vicinity of apex 112 and a second end 406 positioned at the vicinity of transition region 113. Each aperture 108 is positioned a relatively shorter distance from groove first end 405 relative to groove second end 406.

Figure 5:
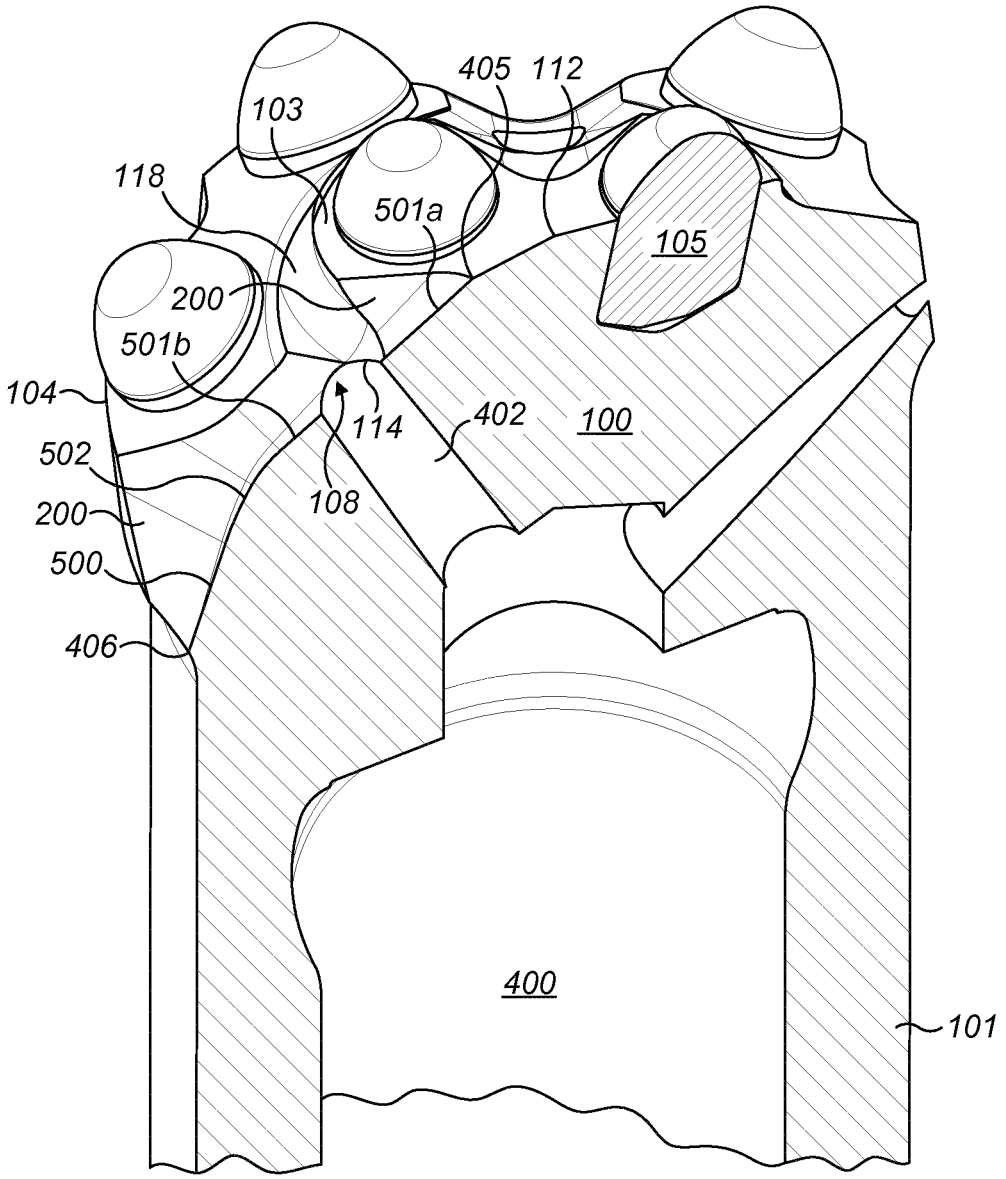
FIG. 5 is a magnified perspective cross sectional view of the bit head of FIG. 4.

Referring to FIG. 5, each grove 107 comprises a first portion represented by references 501*a* and 501*b* and a second portion represented by reference 500. An intermediate curved region 502 is positioned axially between the first and second regions 501*a*, 501*b*, 500. First groove region 501*a*, 501*b* is declined continuously from groove first end 405 so as to slope axially rearward and to be recessed relative to front face 103. First region 501*a*, 501*b* may be further divided into an innermost region 501*a* and an outermost region 501*b*. Region 501*a* extends radially between aperture 108 and groove end 405 whilst region 501*b* extends radially between aperture 108 and curved region 502. Both the inner and outer regions 501*a*, 501*b* are aligned at the same declined angle as one another such that the trough 117 at each region 501*a*, 501*b* is coplanar at each radial side of aperture 108. The groove trough 117 then extends over curved region 502 that represents a smooth transition from the first region 501*a*, 501*b* to the radially outer (and generally axially extending) second region 500. Curved region 502 is also aligned to taper continuously axially rearward towards axis 102 and is devoid of any plateau or shoulder regions that would otherwise be aligned perpendicular to axis 102. As illustrated, the depth of each groove 107 increases generally from first end 405 to the vicinity of the axially extending second region 500. The depth of groove 107 generally decreases in the axially rearward direction along groove second region 500 to terminate at second end 406.

Referring to FIG. 6, the angle by which groove first region 501*a*, 501*b* slopes axially rearward relative to axis 102 is represented generally by angle α. Similarly, the angle by which groove second region 500 slopes rearwardly relative to axis 102 is represented by angle β. According to the specific implementation, angle α is substantially 55° and angle β is substantially 15°. Accordingly, the radially inner first region 501*a*, 501*b* slopes axially rearward to a lesser degree than second groove region 500 having a flow path length that is aligned more in the axial direction than the radial direction in contrast to first region 501*a*, 501*b*. As indicated, intermediate curved region 502 is formed as a smooth transition such that region 501*b* (extending radially between aperture 108 and curved region 502) is continuously sloped in the axially rearward direction. The specific shape profile and configuration of regions 501*b*, 502 and 500 ensures that rock particles and fines entrained within the flushing fluid are transported efficiently from aperture 108 to the bit shank 101. This increases appreciably the penetration rate of the drill bit as rotation and axial forward cutting is optimised by efficient axially rearward transport of the fractured rock material.

Specifically recessing the aperture edge 114 at the groove trough 117 prevents damage to the edge 114 so as to maintain the desired delivery and flow of flushing fluid within each groove 107. As will be appreciated, should edge 114 become damaged or worn so as to be misshapen, the fluid delivery path would be affected and the flushing performance decreased. The specific radial positioning of each aperture 108 radially intermediate the radial positions of front buttons 105 and gauge buttons 106 further optimises the protection of edge 114 from damage during cutting. Protection of edge 114 is further enhanced by a generally circumferentially extending trench 118 that is positioned radially between front buttons 105 and gauge buttons 106. In particular, each aperture 108 is located at the trough region of each trench 118. Furthermore, a generally circumferentially extending shoulder 119 defines a radially inner region of trench 118 that has the effect of providing a shield for edge 114 by way of deflecting or guiding rock debris appropriately into grooves 107.

The invention claimed is:

1. A percussive rock drill bit comprising:

a head provided at one end of an elongate shank having an internal bore extending axially from one end of the shank towards the head;

the head having a front face and a plurality of collar segments spaced circumferentially around a longitudinal axis of the bit and positioned at a perimeter edge of the front face, the front face being dome-shaped and having an apex region that forms an axially forwardmost region of the front face along the longitudinal axis, the front face encompassing a forward facing surface of the collar segments that is continuously tapered axially rearwardly from the apex region to the perimeter edge that forms a maximum outside diameter of the head;

a plurality of front cutting buttons provided at the front face and a plurality of gauge buttons provided at the collar segments;

a plurality of flushing grooves extending in a direction radially outward from the axis at the front face and continuing in a direction axially rearward to define and circumferentially separate the collar segments, each of the grooves terminating at the vicinity of the shank, wherein each flushing groove is recessed into the head such that a trough region of each groove is recessed axially rearward of the front face; and at least one fluid passageway connected to the bore and emerging as an aperture in the vicinity of the front face within at least one of the flushing grooves, the aperture being recessed axially rearward from the front face within the at least one flushing groove, wherein a flow path length of each of the flushing grooves is generally convex in the direction from the front face to the shank relative to the longitudinal axis of the bit, the flow path length being aligned to extend continuously axially rearward from the region of the aperture towards the shank such that no part of the flow path length is aligned perpendicular to the longitudinal axis of the bit so as to provide an unhindered axially rearward flow path for fluid to flow from the aperture towards the shank and between the collar segments, wherein the fluid flow path length of each of the flushing grooves has a first region positioned generally at the front face, a second region positioned generally between each of the collar segments, and a curved intermediate region, wherein the fluid flow path length at the first, second and intermediate regions is seamless and devoid of any ridge or edges aligned perpendicular to the fluid flow path of each of the flushing grooves, the groove trough extending over the curved intermediate region such that there is a smooth transition from the first region to the second region.

2. The bit as claimed in claim 1, wherein each of the flushing grooves extends axially forward beyond each aperture.

3. The bit as claimed in claim 2, wherein an angle of alignment of the flow path length of each of the flushing grooves in the first region axially forward and axially rearward of the aperture is substantially equal.

4. The bit as claimed in claim 1, wherein each of the flushing grooves at the transition between the first and second regions includes a convex curve in the flow path length relative to the axis.

5. The bit as claimed in claim 1, wherein the flow path length in the first region is aligned to be declined to slope towards the axis at an angle in the range 40 to 80° relative to the axis.

6. The bit as claimed in claim 1, wherein the flow path length in the second region is aligned to be declined to slope towards the axis at an angle in the range 5 to 30° relative to the axis.

7. The bit as claimed in claim 1, wherein each of the flushing grooves includes an axially forwardmost region that extends in a direction radially and axially between the front buttons.

8. The bit as claimed in claim 1, wherein each flushing groove includes a first end positioned at the vicinity of an axially forwardmost region of the front face and a second end positioned at the vicinity of the shank, wherein the aperture is positioned closer to the first end than the second end.

9. The bit as claimed in claim 1, wherein each of the flushing grooves includes a generally V-shaped profile in a plane perpendicular to the flow path length of each of the grooves.

10. The bit as claimed in claim 9, wherein a depth of each of the flushing grooves increases generally from the front face towards the shank.

11. The bit as claimed in claim 1, further comprising a trench axially recessed in the front face and extending circumferentially around the axis and perpendicular to the flushing grooves, each aperture being positioned on the circumferential path of the trench such that an axial depth of the trench and each flushing groove at the vicinity of each aperture is substantially equal.

12. The bit as claimed in claim 1, comprising three flushing passageways and three flushing grooves.

* * * * *